United States Patent [19]

Willem

[11] 4,316,054

[45] Feb. 16, 1982

[54] CONNECTION BETWEEN CORE AND CASING OF A STRUCTURE HAVING AN AGGLOMERATED FIBRE CORE

[75] Inventor: Michel Willem, Abrest, France

[73] Assignee: Societe Anonyme dite: CERAVER, Paris, France

[21] Appl. No.: 104,228

[22] Filed: Dec. 17, 1979

[30] Foreign Application Priority Data

Dec. 27, 1978 [FR] France ..... 78 36429

[51] Int. Cl.[3] ..... H01B 17/14; H01B 17/42

[52] U.S. Cl. ..... 174/140 S; 174/158 R; 174/179; 174/189; 403/268

[58] Field of Search ..... 174/140 S, 158 R, 163 R, 174/176, 177, 178, 179, 186, 188, 189, 192; 403/265, 267, 268, 269, 334, 404

[56] References Cited

U.S. PATENT DOCUMENTS 4,057,687 11/1977 Willem ..... 174/179

*Primary Examiner*—Laramie E. Askin

*Attorney, Agent, or Firm*—Kenyon & Kenyon

[57] ABSTRACT

A bending resistant structure includes a rod (1) which is sealed in a casing (6), said casing receiving a double frusto-conical shaped wedging member (2,3,4) which applies jamming stresses to the rod. The wedging member is formed by a resin mass (2) moulded on the end of the rod (1), a resilient cap (3) covering the resin mass (2), and a thin metal sheathing (4) shrink-fitted over the cap (3), said wedging member being sealed in an associated casing (6), the structure being particularly resistant to high bending moments. Application to electric insulators and more particularly to those of the line-post type.

8 Claims, 4 Drawing Figures

ANTI-ROTATION RIB
IV
IV
1
2'
3'
4'
5
6
7
8
9
10
11
12
13
14
15

CONNECTION BETWEEN CORE AND CASING OF A STRUCTURE HAVING AN AGGLOMERATED FIBRE CORE

BACKGROUND OF THE INVENTION

The present invention relates to a structure for transmitting high mechanical stresses, said structure having an elongate core, which includes at least one rod made of agglomerated fibres, and at least one fixing means fixed to an end of the core, said fixing means including a casing and a wedging member itself located on the core and positioned within the casing. The wedging member is flared on either side of an intermediate zone thereof, so as to exert radial compression or jamming stresses on the rod in the casing and to maintain these stresses at least partially in a zone of the structure located in the casing, even when the structure is not subjected to any mechanical loading. Such a structure is described in the applicant's U.S. Pat. No. 4,057,687 patented on Nov. 8, 1977.

When it is required to use such a structure not for vertical suspension, in which case said structure is subjected mainly to traction stresses, but in an application in which the fixing means constitutes a cantilever support, in which case the structure is subjected mainly to bending moments, the design of a structure such as described in the aforementioned patent must be modified because of the high stresses applied to the rod in the fixing means. Such stresses can cause failure because of the fibrous structure of said rod.

Although the aforementioned patent relates particularly to suspension type electric insulators, high bending strength is required more particularly in fixed end beam type insulators such as those commonly called line-post insulators. For example, in practice, an insulator 1700 mm long, mounted as a fixed end beam with its axis inclined at 12° with respect to the horizontal, is required to withstand a vertical load at its free end of 500 DaN.

The present invention modifies the structure described in the aforementioned patent so as to make it more resistant to high bending moments.

SUMMARY OF THE INVENTION

The invention provides a structure for transmitting high mechanical stresses, said structure having an elongate core, which includes at least one rod made of agglomerated fibres, and at least one fixing means fixed to the end of the core, said fixing means including a casing and a wedging member located on the core and positioned within the casing. The wedging member is flared on either side of an intermediate zone thereof, so as to exert radial compression or jamming stresses on the rod when in the casing and to maintain these stresses at least partially in a zone of the structure located in the casing, even when the structure is not subjected to any mechanical loading. The wedging member comprises a resin mass moulded onto the end of the rod, a resilient cap covering the resin mass, and a thin metal sheathing shrink-fitted over the cap, said wedging member being embedded in said casing, whereby the structure is particularly resistant to high bending stresses.

The structure of the invention may also have at least one of the following characteristics:

- the mass of resin moulded on the end of the rod covers said end entirely;

- the resilient cap covers entirely the outer surface of the mass of moulded resin and has suitable elasticity for it to be properly applied on said surface;
- a resilient sleeve is provided around a portion of the rod outside the mass of moulded resin, said sleeve preferably pressing against the mass of moulded resin and having a peripheral groove in which an edge of the shrink-fitted sheathing is inserted and forming a transition cover from the wedging member to a portion of the rod fitted with insulator discs;
- the inner surface of the casing has a bulge extending toward the intermediate zone of the wedging member; and
- the central portion of the mass of moulded resin corresponding to the intermediate zone of the wedging member has longitudinal grooves.

BRIEF DESCRIPTION OF THE DRAWINGS

Other characteristics and advantages of the present invention will become more clearly apparent from the following description given by way of illustration but having no limiting character and with reference to the figures of the accompanying drawings in which.

DETAILED DESCRIPTION

Figure 2:
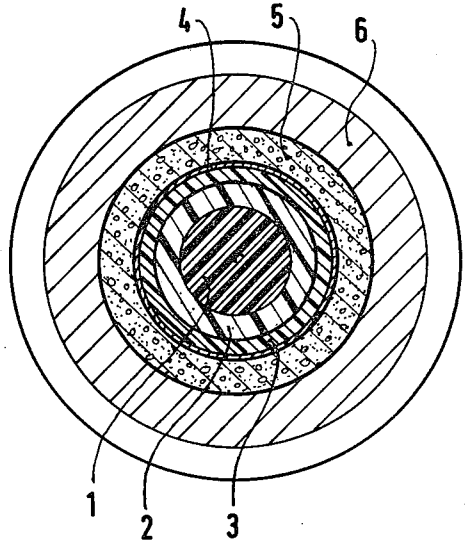
- FIG. 2 is a transverse cross-section through II—II of FIG. 1.
Figure 1:
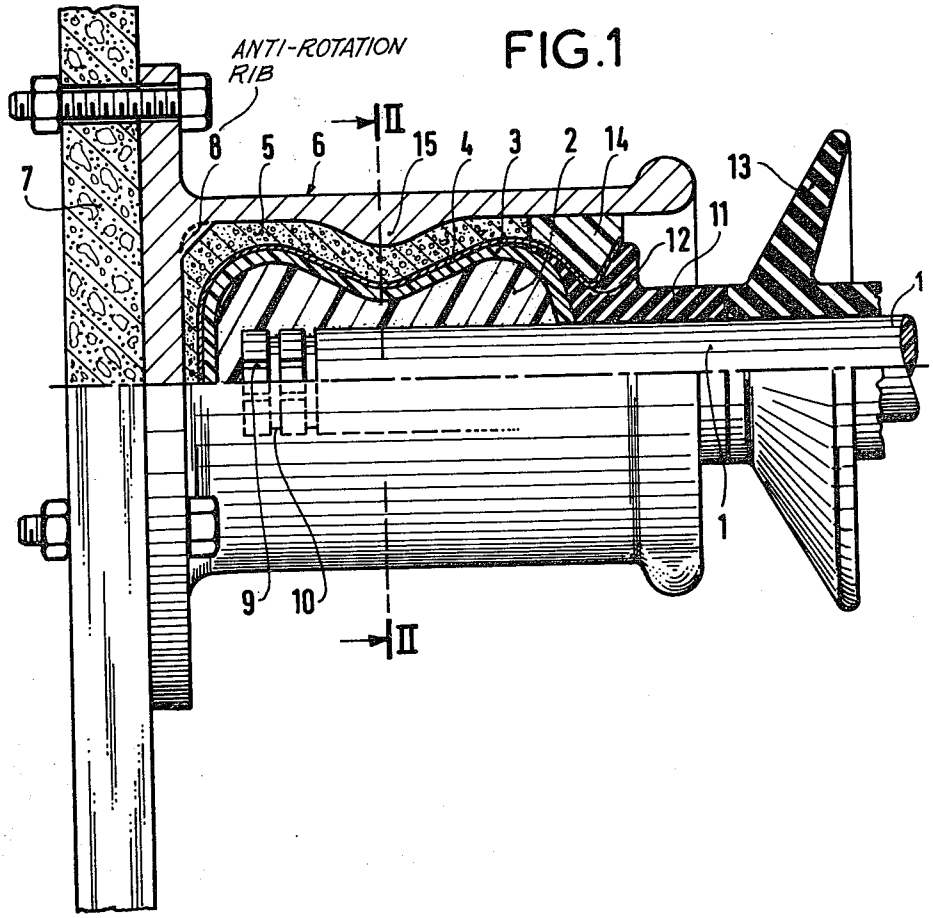
- FIG. 1 is a side view, partly in axial cross-section, of a structure in accordance with the invention.

In FIGS. 1 and 2, the end of a rod 1 made of glass fibres agglomerated by a resin is surrounded by a mass of resin 2 filled and reinforced with glass fibres. Said mass has a double frusto-conical or "diabolo" shape. The advantage of the particular shape has been thoroughly explained in the aforementioned patent. The mass is moulded around the end of the rod in a mould formed in two parts, in a way known per se. To improve connection between the rod and the mass of resin, it is possible to polymerize the resin of the rod only partially before moulding the diabolo-shaped mass, then to allow polymerization to continue until the resin is completely polymerized.

The mass of resin 2, covered by a resilient cap 3 and having a thin metal sheathing 4 shrink-fitted thereon (e.g. by isostatic pressure), constitutes a wedging member which is subsequently sealed by means of a mass of cement 5 in a substantially horizontal casing 6 fixed by bolts to a generally vertical support 7, to enable the structure to withstand great bending forces.

In actual fact, the stresses to which the end of the core in its fixing means is subjected are extremely complex, since traction and torsional forces also are involved besides the main bending moments.

As explained in the aforementioned patent, the wedging member of double frustoconical, or "diabolo," shape avoids too great a concentration of the shearing stresses in a small zone of the rod, due to the fact that when the structure is subjected to tension the diabolo shape is capable of sliding longitudinally a short distance in the fixing means. The diabolo shape also turns out to be advantageous, as explained hereinafter, for a fixed end beam application of the structure.

In such an application, the rod which constitutes the core of an insulator is subjected mainly to bending due to a perpendicular force applied to its free end, the portion of the rod situated on the side of the neutral axis is subjected to tension stresses which must be compensated by the fixing means, but traction from the fixing means can be transmitted thereto only by longitudinal shearing stresses at the interface between the rod and the fixing means. Resistance to these shearing stresses is increased if transverse compression stresses are developed simultaneously.

The portion of the rod located on the other side of the neutral axis is subjected to longitudinal compression stresses, which could be counteracted in the fixing means by pressure of the end of the portion of the rod on the other side of the neutral axis against the bottom of the casing 6. However, these longitudinal compression stresses must not be allowed to become too high or the rod end may be crushed. The modified wedging member of the present invention increases the resistance to longitudinal shearing stresses on the compression side of the rod and therefore reduces these compression stresses. Further, between the side of the rod which is subjected to longitudinal traction and the other side which is subjected to longitudinal compression, longitudinal shearing stresses develop and tend to make the rod delaminate. The addition of the wedging member, which applies radial compression over a distributed surface area of the rod, certainly reduces such a tendency towards delamination.

Further, the force applied to the free end of the rod tends to make the rod pivot in the fixing means (i.e. the combination of wedge member, cement 5 and casing 6). The pivoting movement is opposed by reaction forces applied perpendicularly to the rod at the ends of the fixing means.

If the fixing means does not have a diabolo shaped wedge member, very high compression stresses occur in the rod at the bearing zones at the ends of the fixing means. Such stresses occur nowhere outside the bearing zones; so the longitudinal fibres located near the surface of the rod in these two zones are subject to high transverse shearing stresses which they do not withstand at all well.

The diabolo shape distributes these compression stresses better by spreading them out, thereby reducing the transverse shearing stresses. It is therefore possible to reduce the most critical stresses applied to the rod in the fixing means by judiciously distributing the reactions of the fixing means, namely, firstly, the compression reaction against the end of the fixing means which gives rise to longitudinal shearing stresses within the rod and secondly, the reaction moment forces which give rise to transverse shearing stresses.

In the present case, the modification of the structure already described in the aforementioned patent to include a resilient cap 3 is advantageous because it provides resilient and essentially hydrostatic fixing means and is adaptable to the conditions of use of said structure.

Indeed, if high retaining traction forces are expected, the jamming of the rod in the fixing means will be considerably increased if the sealing material 5 and the surface condition of the formed thin sheathing 4 are chosen so that they can slide at their contact interface. In contrast, if moderate retaining traction forces are expected, adherence between said sheathing and the sealing mass must be sufficient but not detrimental. It should be noted that in some cases, torsion stresses can be very high and that anti-rotation means should therefore be provided; for example, the sides of the rod with wedging means could have flat surfaces. In all cases, the resilient cap plays an important part in evenly distributing the stresses applied to the end of the rod fitted with the diabolo-shaped wedging means.

In any case, it is essential to prevent relative rotational sliding between the sealing material 5 and the casing 6. This is best done in a way known per se by anti-rotation ribs 8 inside said casing. It is also essential to prevent relative rotation between the rod 1 and the mass of moulded resin 2. This is best done by longitudinal grooves 9 formed in the circumference of the rod. These grooves are located next to the conventional annular grooves 10 provided on the rod to increase resistance to longitudinal sliding between said rod and the diabolo-shaped mass of resin.

Besides the purely mechanical behaviour of the core when embedded in the fixing means, it is necessary to bear in mind the electrical behaviour and the sealing of said structure when it is more particularly intended for application to electric insulators of the line-post type.

As far as concerns the electrical behaviour, another advantage provided by the present invention with respect to the aforementioned patent resides in the formed metal sheathing which forms an equipotential surface. This improves electrostatic protection.

As far as concerns sealing, the present invention is also advantageous, since it provides a generally sealed assembly in which no link with the casing 6 is used for sealing. For this purpose there is provided a resilient sleeve 11 which surrounds a portion of the rod outside the mass of moulded resin; the sleeve presses against the mass of moulded resin covered with its resilient cap and has a peripheral groove 12 in which the edge of the sheathing 4 is inserted so that when the sheathing is shrink-fitted, it presses the sleeve 11 against the cap 3. This improves sealing and prevents said sleeve from parting from said cap if connection bonding is provided. The resilient sleeve 11 forms a transition cover up to a zone of the rod which is equipped with insulator discs 13. Note the advantage of a sheathing which constitutes an equipotential surface for the contact surface between the cap 3 and the sleeve 11.

Since sliding of the diabolo-shaped wedging means must not be hindered by a positive stop, the sealing mass 5 must not completely fill the space between the sleeve and the inner surface of the casing, so it may be useful to provide for the free volume to be filled with filling material 14, e.g. filled resin which improves the electrical behaviour due to proper matching to electrical conditions. Further, a bulge 15 in the casing improves the adhesion of the sealing material.

Figures 3, 4:
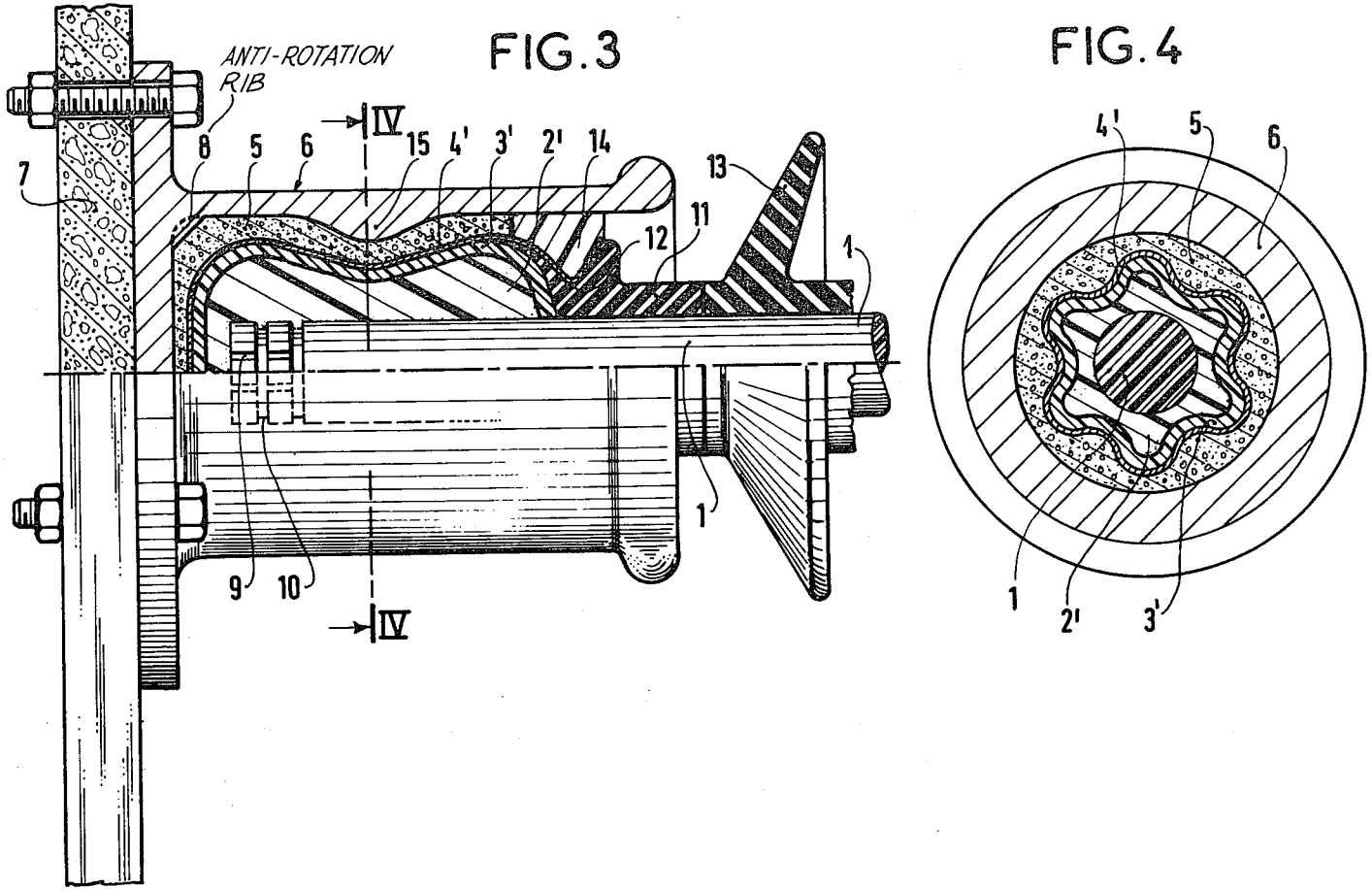
- FIGS. 3 and 4 illustrate respectively a side view, partly in axial cross-section, and a transverse cross-section through IV—IV of FIG. 4 of a variant of the structure of FIGS. 1 and 2.

FIGS. 3 and 4 illustrate a variant in which the central portion of the mass of moulded resin 2' and of the cap 3' has longitudinal grooves which make it easier to form the sheathing 4' and further prevent rotation of the diabolo-shaped wedging means in the casing 6. The rest of the structure is identical to that described hereinabove with reference to FIGS. 1 and 2.

From the materials point of view, it is recommended, by way of example, to use a sufficiently hard elastomer such as polyurethane for the resilient cap 3, a ductile metal such as copper or aluminium for the shrink-fitted sheathing 4 and an elastomer such as a copolymer of the dimethylethylenepropylene rubber type for the sleeve 11 (and for the discs 13). The sealing material 5 is preferably made of a filled resin or an inorganic cement.

It is self-evident that the invention is in no way limited to the examples which have been given by way of illustration, but includes any variant which, with equivalent means, conforms to the general definition of the invention in the appended claims.

I claim:

1. A structure for transmitting high mechanical stresses, said structure having an elongate core, which includes at least one rod made of agglomerated fibres, and at least one fixing means fixed to an end of the core, said fixing means including a casing, a wedging member located on the core and positioned within said casing, said wedging member being flared on either side of an intermediate zone thereof, so as to exert radial compression or jamming stresses on the rod in the casing and to maintain these stresses at least partially in a zone of the structure located in the casing, even when the structure is not subjected to any mechanical loading, characterized in that the wedging member is formed by a mass of resin moulded onto the end of the rod, a resilient cap covering the resin mass, and a thin metal sheathing shrink-fitted over the resilient cap, said wedging member being embedded in said casing, whereby the structure is particularly resistant to high bending stresses.

2. A structure according to claim 1, characterized in that the mass of resin moulded on the end of the rod covers said end entirely.

3. A structure according to either one of claims 1 and 2, characterized in that the resilient cap covers entirely the outer surface of the mass of moulded resin and has suitable elasticity for it to be properly applied on said surface.

4. A structure according to claim 1, characterized in that a resilient sleeve is provided around a portion of the rod outside the mass of moulded resin.

5. A structure according to claim 4, characterized in that the sleeve presses against the mass of moulded resin and has a peripheral groove in which an edge of the shrink-fitted sheathing is inserted.

6. A structure according to either one of claims 4 and 5, characterized in that a portion of the rod beyond the fixing means is fitted with insulator discs, and the sleeve forms a transition cover up to the portion of the rod fitted with insulator discs.

7. A structure according to claim 1, characterized in that the inner surface of the casing has a bulge extending toward the intermediate zone of the wedging member.

8. A structure according to claim 1, characterized in that the central portion of the mass of moulded resin corresponding to the intermediate zone of the wedging member has longitudinal grooves.

* * * * *